US012320204B1

(12) United States Patent
Zhan et al.

(10) Patent No.: US 12,320,204 B1
(45) Date of Patent: Jun. 3, 2025

(54) INTERCONNECTABLE DOWNHOLE INSTRUMENT PACKAGE

(71) Applicant: CHINA PETROLEUM & CHEMICAL CORPORATION, Beijing (CN)

(72) Inventors: Sheng Zhan, Houston, TX (US); Derek M. Shumaker, Houston, TX (US); Sam Seldon, Houston, TX (US)

(73) Assignee: CHINA PETROLEUM & CHEMICAL CORPORATION, Beijing (CN)

( * ) Notice: Subject to any disclaimer, the term of this patent is extended or adjusted under 35 U.S.C. 154(b) by 0 days.

(21) Appl. No.: 18/635,758

(22) Filed: Apr. 15, 2024

(51) Int. Cl.
*E21B 17/02* (2006.01)
*E21B 47/01* (2012.01)
*E21B 47/06* (2012.01)

(52) U.S. Cl.
CPC ..... *E21B 17/028* (2013.01); *E21B 47/01* (2013.01); *E21B 47/06* (2013.01)

(58) Field of Classification Search
CPC ..... E21B 17/028; E21B 47/06; E21B 47/13; E21B 47/01; E21B 47/013; H01R 39/64; H01R 2201/20
See application file for complete search history.

(56) References Cited

U.S. PATENT DOCUMENTS

| | | | | |
|---|---|---|---|---|
| 3,486,107 | A * | 12/1969 | Richter, Jr. | E21B 47/12 174/525 |
| 4,660,910 | A * | 4/1987 | Sharp | E21B 17/042 439/194 |
| 11,725,462 | B1 * | 8/2023 | Tchakarov | E21B 17/023 166/65.1 |
| 2005/0205304 | A1 * | 9/2005 | Gurjar | E21B 47/017 175/320 |
| 2010/0236777 | A1 * | 9/2010 | Partouche | E21B 17/206 166/254.2 |
| 2024/0287856 | A1 * | 8/2024 | Alghanmi | E21B 17/028 |

* cited by examiner

*Primary Examiner* — Brad Harcourt
(74) *Attorney, Agent, or Firm* — NKL Law; Allen Xue

(57) ABSTRACT

An interconnectable downhole instrument package has a downhole instrument disposed in a pressure housing; a male connector assembly connecting to a first end of the downhole instrument; and a female connector assembly connecting to a second end of the downhole instrument. The male connector assembly has a first housing and a male rotatable connector that are connected together, while the female connector assembly has a second housing and a female rotatable connector. The second housing is adapted to receive the female rotatable connector.

11 Claims, 7 Drawing Sheets

110

INTERCONNECTABLE DOWNHOLE INSTRUMENT PACKAGE

TECHNICAL FIELD

The present disclosure provides interconnectable downhole instrument packages and a tool string containing multiple downhole instrument packages, especially adapted for oil and gas exploration.

BACKGROUND

Modern oil and gas exploration techniques rely heavily on the ability to measure the operating conditions and the formation environment while drilling. For example, directional drilling requires real-time monitoring of the inclination and azimuth of the wellbore at the location near the drill bit, which can be accomplished by using accelerometers and magnetometers. Further, data collected by the sensors are transmitted to the surface using a mud-pulse telemetry system or an electromagnetic telemetry system. Instruments that measure and transmit such directional information are often referred to as measurement-while-drilling (MWD) instruments/tools. Directional drilling also requires formation properties to guide the drill bit to reach the pay zone. The formation properties include density, porosity, resistivity, acoustic-caliper, magnetic resonance and formation pressure, each are measured by a special instrument. Instruments that measure formation properties are often referred to as logging-while-drilling (LWD). In this disclosure, MWD and LWD instruments may be used interchangeably and, together with the battery, be collectively referred to as downhole instruments. The numerous downhole instruments required for drilling need to be mechanically connected and/or electrically connected to form a tool string.

There is a need for interconnectable downhole instrument packages that are easy to install and replace, as well as mechanically strong.

SUMMARY

In one embodiment of the current disclosure, an interconnectable downhole instrument package has a downhole instrument disposed in a pressure housing; a male connector assembly connecting to a first end of the downhole instrument; a female connector assembly connecting to a second end of the downhole instrument.

The male connector assembly has a first housing and a male rotatable connector that are connected together, while the female connector assembly has a second housing and a female rotatable connector. The second housing is adapted to receive the female rotatable connector.

The male rotatable connector has a first end comprising a plurality of cylinders that are sequentially and concentrically connected, and a second end adapted to receive a first plurality of electrical wires, a first plurality of electrical contacts disposed on the plurality of cylinders, and the female rotatable connector has a first end having a cavity having a plurality of steps adapted to receive the plurality of cylinders in the male rotatable connector, and a second end adapted to receive a second plurality of electrical wires.

In another embodiment of the current disclosure, the interconnectable downhole instrument package further include a lap joint having a first portion of the lap joint affixed inside the first housing and a second portion of the lap joint affixed inside the pressure housing.

According to one aspect of the embodiment, the first portion of the lap joint has a first channel and the second portion of the lap joint has a second channel, wherein the first channel and the second channel are connected.

According to another aspect of the embodiment, the second channel in the lap joint is connected to a slot in the second portion of the lap joint, wherein the slot is configured to receive an electrical connector.

According to a further aspect of the embodiment, the male connector assembly and the female connector assembly are configured to be connected together using a tubular fastener.

According to other embodiments in this disclosure, the downhole instrument is selected from a directional sensor, a battery pack, a pulser, a Gamma probe both non-focused and focused, an alternator, a gyroscope, a vibration monitor, a pressure sensor, an electromagnetic (EM) telemetry, a resistivity sensor, a nuclear logging tool, and an acoustic sensor.

In a further embodiment of the current disclosure, a tool string for downhole operation includes two or more interconnectable downhole instrument packages. The male rotatable connector in the first interconnectable downhole instrument package is connected to the female rotatable connector in the second downhole instrument package.

According to yet another embodiment, a method for characterizing a subsurface formation includes the steps of drilling a wellbore that extends into the subsurface formation; lowering the tool string in the wellbore; operating the tool string to obtain signals reflecting parameters of the subsurface formation; and transmitting the signals to a surface instrument for analysis. The tool string can be installed in the drill string and used in MWD and LWD operations. The tool string can also be used in the sonde for wireline-logging operation.

BRIEF DESCRIPTION OF THE DRAWINGS

The teachings of the present invention can be readily understood by considering the following detailed description in conjunction with the accompanying drawings.

Figure 1:
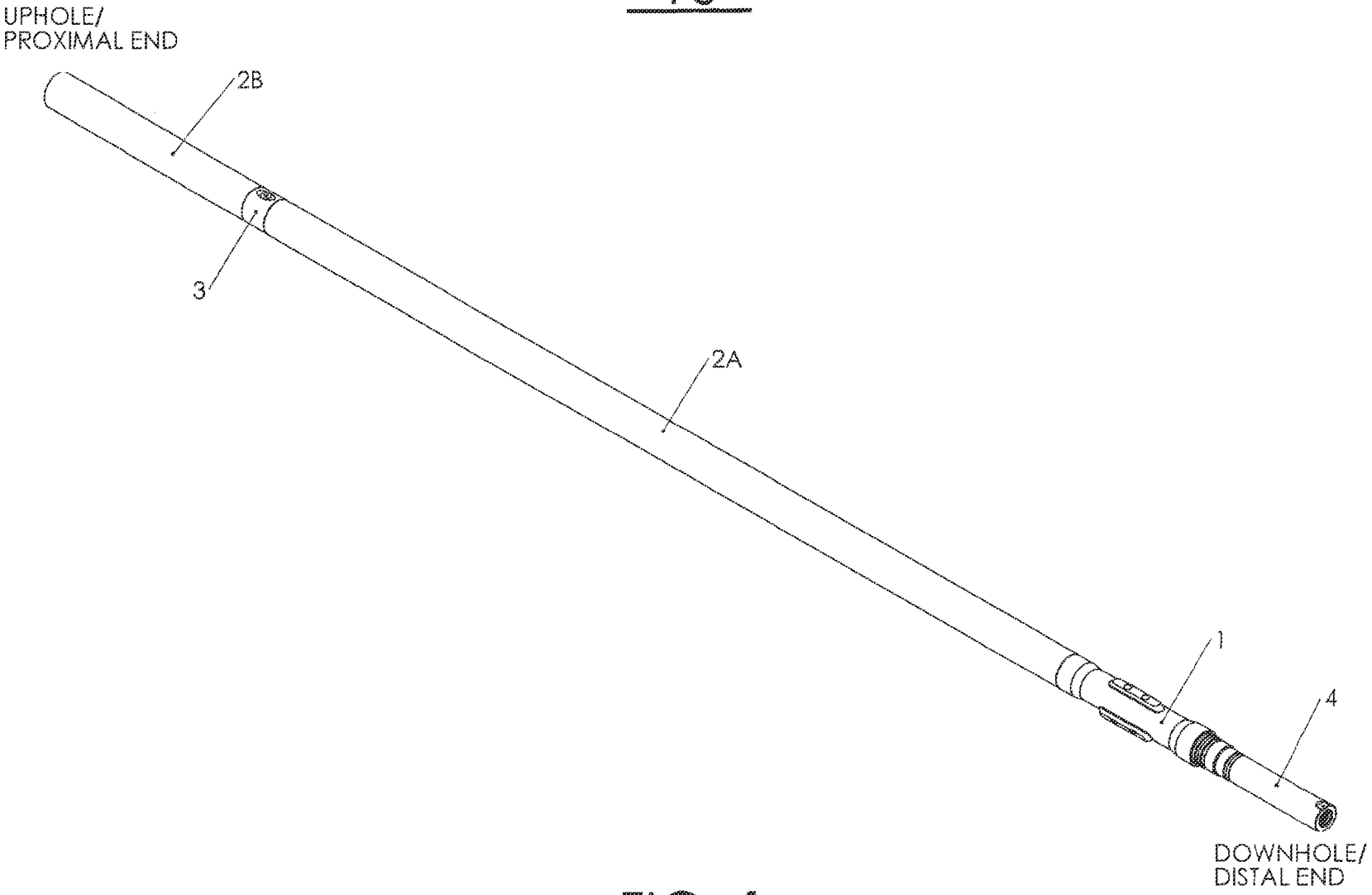
FIG. 1 is an isometric view of the downhole instrument assembly having a male rotatable connector assembly and a female connector assembly.

The following table lists the reference numerals in the drawings.

| | |
|---|---|
| 10-downhole instrument package | 1-female connector housing |
| 101-proximal end | 102-distal end |
| 110-lap joint | 120-wire connector |
| 130-wire connector | 2A-first pressure housing |
| 2B-second pressure housing | 3-male connector housing |
| 301-proximal end | 302-distal end |
| 303-machine key | 4-female rotatable connector |

-continued

| | |
|---|---|
| 401-solder cup | 5-male rotatable connector |
| 501-ground conductor band | 502-conductor bands for Hall effect sensor power |
| 503-conductor bands for motor phase power | 504-conductor bands for Hall effects ensor signals |
| 505-solder cup | 506-machine key |
| 6-female rotatable connector cap | 7-male rotatable connector cap |
| 8-split coupling | 11-rubber centralizer |
| 12-metal disk | 13-rubber centralizer pad |
| 14-filler | 20a-electrical wire bundle |
| 20b-electrical wire bundle | 200-downhole instrument |

DETAILED DESCRIPTION

Reference will now be made in detail to embodiments of the present disclosure, examples of which are illustrated in the accompanying drawings. It is noted that wherever practicable, similar or like reference numbers may be used in the drawings and may indicate similar or like elements.

The drawings depict embodiments of the present disclosure for purposes of illustration only. One skilled in the art would readily recognize from the following description that alternative embodiments exist without departing from the general principles of the disclosure.

Figure 2:
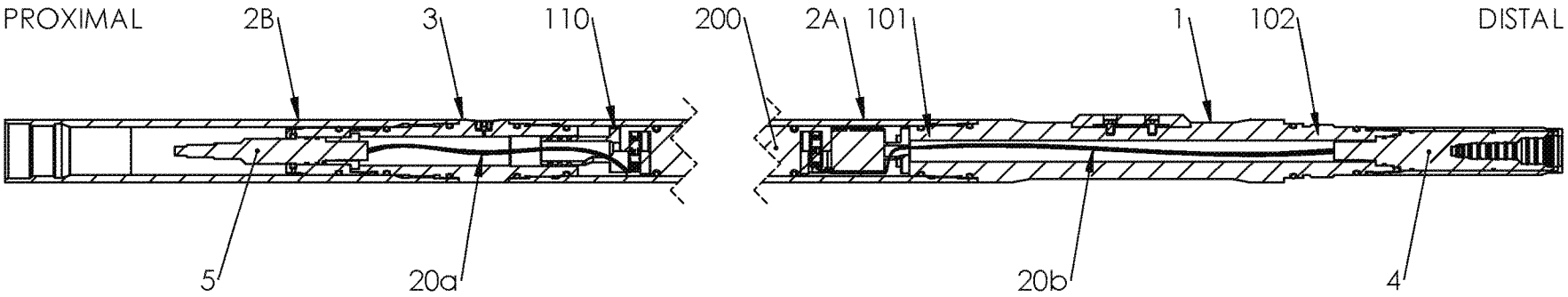
FIG. 2 is a sectional view of the downhole instrument assembly of FIG. 1.

FIGS. 1 and 2 show an interconnectable downhole instrument of the current disclosure, which houses a downhole instrument 200 in the first pressure housing 2A. The first pressure housing 2A is connected to the male connector assembly 3 on the proximal end of the first pressure housing 2A and a female connector assembly 4 on the distal end of the first pressure housing 2A. A portion of the male connector assembly 3 is extended into the second pressure housing 2B.

Figure 3B:
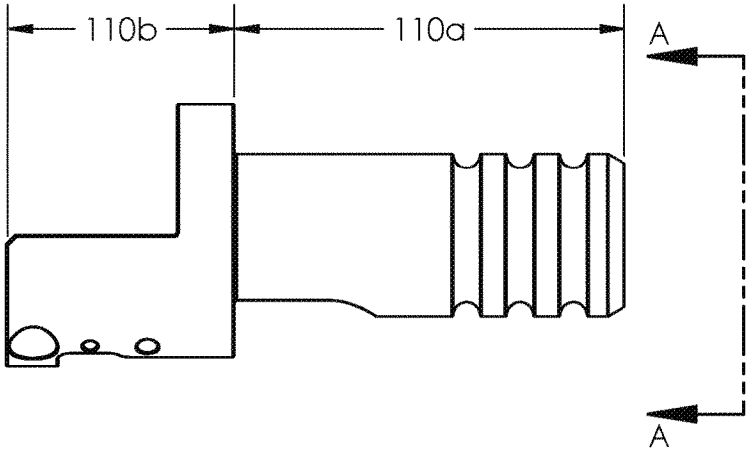
FIG. 3B is the side view of the lap joint.
Figure 3C:
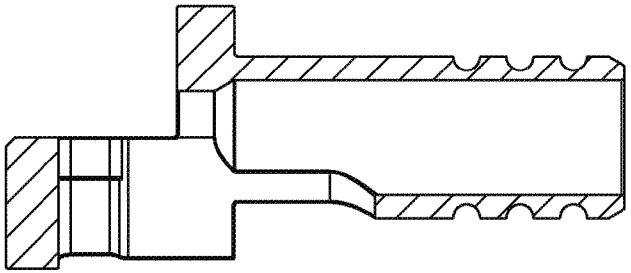
FIG. 3C is the sectional view of the lap joint.
Figure 3A:
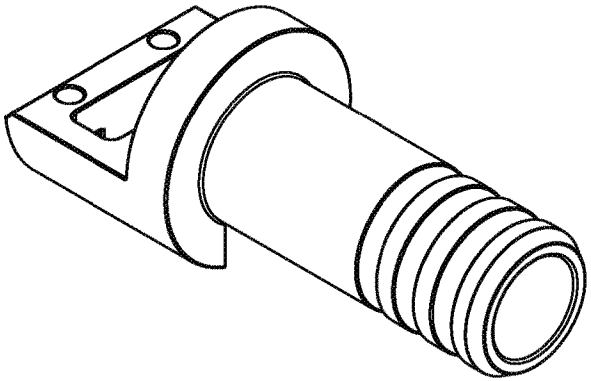
FIG. 3A is an isometric view of an embodiment of the lap joint in this disclosure.

FIGS. 3A-3C show the lap joint 110, which has a hollow first cylindrical portion 110*a* connected to a larger, hollow, second cylindrical portion 110*b*. The first cylindrical portion 110*a* has three o-ring grooves for receiving o-rings. Its outer diameter is approximately the same as the inner diameter of the distal end portion of the male connector housing 3. The second cylindrical portion 110*b* has an outer diameter matching the inner diameter of the first pressure housing 2A and is inserted into the distal end portion of the first pressure housing 2A when assembled. The second cylindrical portion 110*b* has a cut-off section that exposes a slot configured to receive the wire connector 120 (shown in FIG. 4), e.g., an MDM connector. The hollow centers of the first and the second cylindrical portion forms a channel for the passage of electrical wires.

Referring again to FIG. 2, the first cylindrical portion 110*a* is inserted into the male connector housing 3 while the second cylindrical portion 110*a* is affixed inside the first pressure housing 2A. A bundle of electrical wires 20*a* from the male rotatable connector 5 extends through the channel in the male connector housing 3 and the lap joint 110 and is connected to the downhole instrument 200, e.g., using an electrical connector 120. Likewise, another electrical wire bundle 20*b* runs through the channel in the female connector housing 1 between connector 130 in the downhole instrument 200 and the female connector assembly 4.

Figure 4:
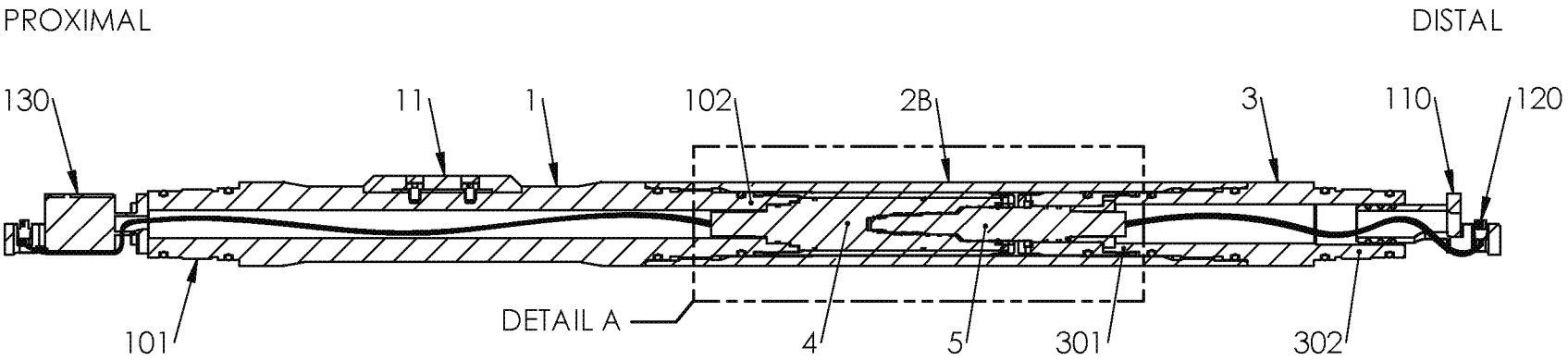
FIG. 4 shows the male connector assembly and the female connector assembly connected together.

In a tool string having two or more adjacent interconnectable downhole instruments, the instrument packages are connected by having the male rotatable connector 5 of one interconnectable downhole instrument package inserted into the female connector assembly 4 of an adjacent interconnectable downhole instrument package, as illustrated in FIG. 4.

Referring to FIG. 4, the female connector assembly has a housing 1 having a proximal end 101 and a distal end 102. The female rotatable connector 4 is inserted into the distal end 102 of the housing 1. The male rotatable assembly has a housing 3 with a proximal end 301 and a distal end 302, and the male rotatable connector 5. The male rotatable connector 5 has one end received by the female rotatable connector 4 and the other end disposed about the distal end 302 of the housing 3.

Figure 5:
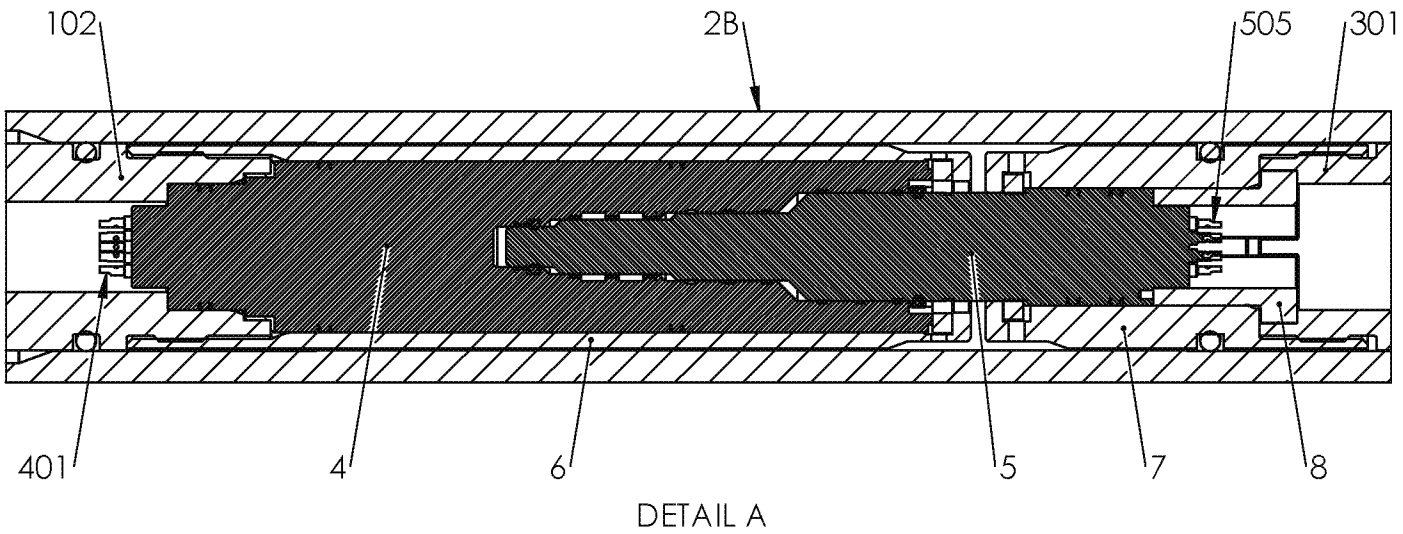
FIG. 5 shows section A-A in FIG. 4 without the electrical wires.

FIG. 5 shows the insert (Detail A) in FIG. 4 while FIG. 5 is an isometric view of the male connector assembly. FIGS. 4 and 5 provide more details regarding the connections between the male and female connector assemblies. First, the female rotatable connector 4 has a solder cup 401, which the electrical wire bundle 20*a* (shown in FIGS. 2 and 4) is soldered to. Likewise, the male rotatable connector 5 has a solder cup 505, which the electrical wire bundle 20*b* (shown in FIGS. 2 and 4) is soldered to. Further, both the female rotatable connector 4 and the male rotatable connector 5 have electrical contact points that cooperatively form conduits for power and signals when assembled. Used herein, electrical contacts can be any suitable means that form a conduit for an electrical current when in contact with one another.

Figure 6:
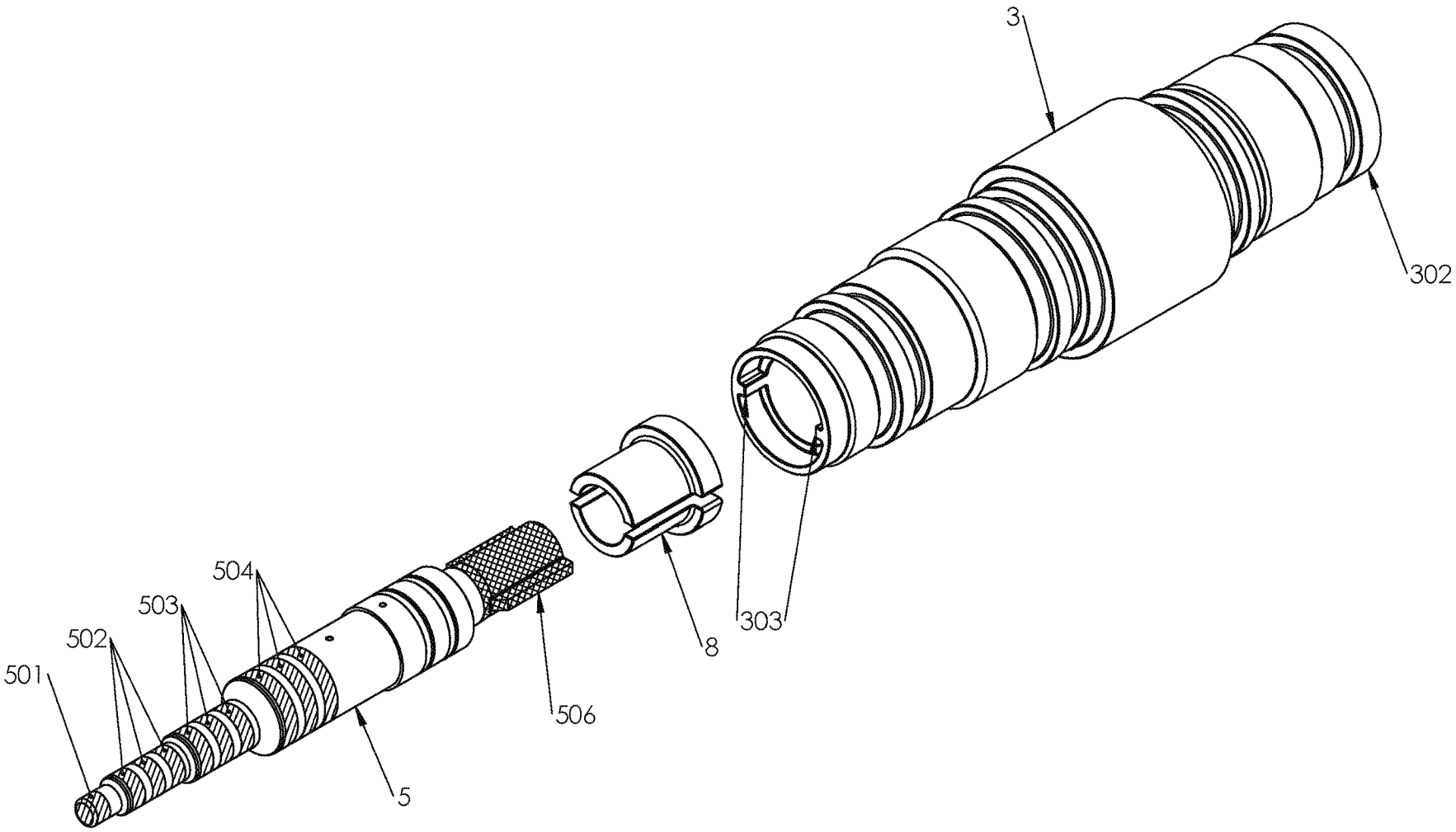
FIG. 6 is an exploded view of the male connector assembly.

As shown in FIGS. 5 and 6, one embodiment of the male rotatable connector 5 has four cylinders of various diameters sequentially and concentrically disposed. The outer surfaces of the four concentric cylinders form four steps. Each step has one or more electrical contacts disposed thereon. In some embodiments, conductor band 501 disposed on the first step is for electrical grounding; conductor bands 502 disposed on the second step are for Hall effect sensor power for powering a Hall sensor switch of a DC brushless motor (not shown) electrically and signally connected to the interconnector; conductor bands 503 disposed on the third step are for supplying power to the DC brushless motor (not shown); and conductor bands 504 disposed on the fourth step are for passing signals to the Hall effect sensor (not shown). In other embodiments, all conductor bands have the same voltage and current rating so that each of them can carry power or data signals. In still other embodiments, the conductor bands may have different ratings so that some of them are designed to carry power while others are configured to carry data signals.

Correspondingly, the distal portion of the female rotatable connector 4 forms a cavity having four steps corresponding to the four steps in the male rotatable connector 5. Each of the four steps in the female rotatable connector 4 also have contacts configured to form electrical connections with the conductor bands on the male rotatable connector 5 after assembly, such as Ramtac© available from RAMPART PRODUCTS.

The male rotatable connector 5 also have a machine key 506, while the housing 3 also has a machine key 303. When assembled, the machine keys 506 and 303 are locked in place by the split coupling 8 so that the male rotatable connector 5 and the housing 3 are integrated and adapted to rotate together. The machine key 506 can be made from metal or from an epoxy resin. For example, the epoxy machine key 506 is bonded to the solder cup end of the male rotatable connector using a mold. Liquid epoxy is poured into the mold and allowed to fully cure. The mold is then removed to obtain the machine key 506 affixed to the end of the male rotatable connector 5 as shown in FIG. 6.

Further, as shown in FIG. 5, the female rotatable connector 4 is retained by the cap 6 that is threadedly connected to the proximal end 101 of the housing 1. Likewise, the male rotatable connector is retained by the cap 7, which is threadedly connected the distal end 302 of the housing 3. Accordingly, the female connector assembly and the male connector assembly are self-contained parts that can be tied together by tightening the female connector housing 1 and the second pressure housing 2B.

During installation, the proximal end 101 of the female connector assembly is connected to a first downhole instrument while wires/cables (e.g., 20*b*) from the first downhole instrument are soldered to the solder cups 401. Likewise, the distal end 302 is mechanically connected to a second downhole instrument while wires/cables (e.g., 20*a*) from the second downhole instruments are soldered to the solder cups 505. The second pressure housing 2B is threaded onto both the female connector assembly 1 and the male connector assembly 3. Subsequently, the male rotatable connector 5 can slide into the female rotatable connector 4 and firmly connected by tightened the second pressure housing 2B.

Figure 7:
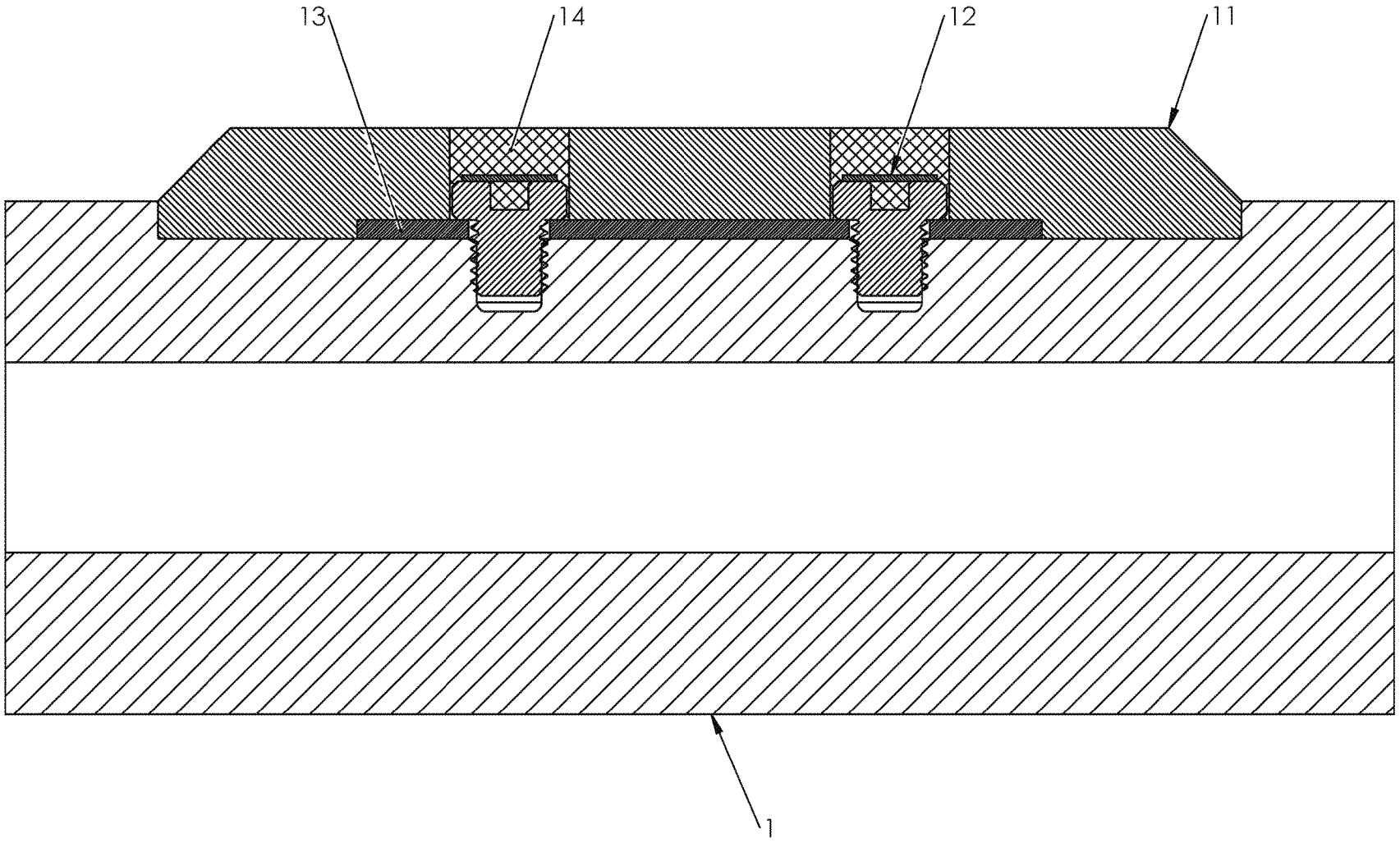
FIG. 7 shows details of the centralizer disposed on the female rotatable connector housing.

FIG. 7 shows a centralizer 11 on the housing 1 of the female connector assembly, which stabilizes the female connector assembly in the downhole sub. The centralizer 11 can be made of rubber, silicone, or other suitable materials. In this embodiment, it is affixed to the outer surface of housing 1 by two screws. The top of each screw is covered by a metal disk 12 (e.g., brass) while the screw holes are filled with a filler, such as the room temperature vulcanizing silicone, e. g., RTV. The filler 14 and the metal disks 12 prevent or delay corrosion.

The downhole instrument 200 can be a directional sensor, a battery pack, or other instruments, e.g., a pulser, a Gamma probe both non-focused and focused, a battery, an alternator, a gyroscope, a vibration monitor, a pressure sensor, an electromagnetic (EM) telemetry, a resistivity sensor, a nuclear logging tool, or an acoustic sensor.

Modules such as shown in FIGS. 1 and 3 can be connected to one another by connecting the distal end of the female connector assembly in one downhole instrument package with the proximal end of the second pressure housing 2B in an adjacent module, thereby forming a tool string having multiple downhole instruments sequentially connected.

While embodiments of this disclosure have been shown and described, modifications can be made by one skilled in the art without departing from the spirit or teaching of this invention. The embodiments described herein are exemplary only and are not limiting. Many variations and modifications of methods, systems and apparatuses are possible and are within the scope of the invention. Accordingly, the scope of protection is not limited to the embodiments described herein. The scope of protection is only limited by the claims. The scope of the claims shall include all equivalents of the subject matter of the claims.

What is claimed is:

1. An interconnectable downhole instrument package, comprising:

a downhole instrument disposed in a first pressure housing;

a male connector assembly connecting to a first end of the downhole instrument;

a female connector assembly connecting to a second end of the downhole instrument; and a lap joint, wherein:

the male connector assembly comprises a first housing and a male rotatable connector that are connected together, the female connector assembly has a second housing and a female rotatable connector, wherein the second housing is adapted to receive the female rotatable connector, the male rotatable connector has a first end comprising a plurality of cylinders that are sequentially and concentrically connected, and a second end adapted to receive a first plurality of electrical wires, a first plurality of electrical contacts disposed on the plurality of cylinders, the female rotatable connector has a first end having a cavity having a plurality of steps adapted to receive the plurality of cylinders in the male rotatable connector, and a second end adapted to receive a second plurality of electrical wires and a first portion of the lap joint is affixed inside the first housing and a second portion of the lap joint is affixed inside the first pressure housing.

2. The interconnectable downhole instrument package of claim 1, wherein the first portion of the lap joint has a first channel and the second portion of the lap joint has a second channel, wherein the first channel and the second channel are connected.

3. The interconnectable downhole instrument package of claim 2, wherein the second channel is connected to a slot in the second portion of the lap joint, wherein the slot is configured to receive an electrical connector.

4. The interconnectable downhole instrument package of claim 1, wherein one or more electrical wire extends through the lap joint and connects the male rotatable connector and the downhole instrument.

5. The interconnectable downhole instrument package of claim 1, wherein the male connector assembly and the female connector assembly are configured to be connected together using a second pressure housing.

6. The interconnectable downhole instrument package of claim 1, wherein the female rotatable connector is affixed to the second housing by a cap.

7. The interconnectable downhole instrument package of claim 1, wherein the male connector assembly further comprises a first machine key affixed to the second end of the male rotatable connector, a second machine key affixed to a first end of the first housing, and a split coupling configured to receive the first machine key and the second machine key so as to form a connection between the male rotatable connector and the first housing.

8. The interconnectable downhole instrument package of claim 1, wherein the downhole instrument is selected from a directional sensor, a battery pack, a pulser, a Gamma probe both non-focused and focused, an alternator, a gyroscope, a vibration monitor, a pressure sensor, an electromagnetic (EM) telemetry, a resistivity sensor, a nuclear logging tool, and an acoustic sensor.

9. A tool string for downhole operation, comprising two or more interconnectable downhole instrument packages of claim 1, wherein the male rotatable connector in a first interconnectable downhole instrument package is connected to the female rotatable connector in a second downhole instrument package.

10. The tool string of claim 9, wherein the first interconnectable downhole instrument package comprises a first downhole instrument and the second downhole instrument package comprises a second downhole instrument, wherein the first downhole instrument and the second downhole instrument are independently selected from a directional sensor, a battery pack, a pulser, a Gamma probe both non-focused and focused, an alternator, a gyroscope, a vibration monitor, a pressure sensor, an electromagnetic (EM) telemetry, a resistivity sensor, a nuclear logging tool, and an acoustic sensor.

11. A method for characterizing a subsurface formation, comprising:

drilling a wellbore that extends into the subsurface formation;

lowering the tool string of claim 9 the wellbore;

operating the tool string to obtain signals reflecting one or more parameters of the subsurface formation; and transmitting the signals to a surface instrument for analysis.

* * * * *